US006205715B1

(12) United States Patent
Rex, Jr.

(10) Patent No.: US 6,205,715 B1
(45) Date of Patent: Mar. 27, 2001

(54) GUTTER GUARD SUPPORT

(76) Inventor: Maurice William Rex, Jr., 525 Woods End, Portage, MI (US) 49002-0529

( * ) Notice: Subject to any disclaimer, the term of this patent is extended or adjusted under 35 U.S.C. 154(b) by 0 days.

(21) Appl. No.: 09/310,066

(22) Filed: May 11, 1999

(51) Int. Cl.[7] ..... E04D 13/076
(52) U.S. Cl. ..... 52/12; 52/712; 52/741.3
(58) Field of Search ..... 52/12, 741.3, 712

(56) References Cited

U.S. PATENT DOCUMENTS

| | | | |
|---|---|---|---|
| 608,844 | 8/1898 | Dick . | |
| 669,495 | 3/1901 | Babcock . | |
| 672,701 | 4/1901 | Daniel . | |
| 1,732,058 | 10/1929 | Martini . | |
| 2,219,953 | 10/1940 | Fry . | |
| 2,229,381 | 1/1941 | Grow . | |
| 2,288,121 | 6/1942 | Cisar et al. . | |
| 2,636,458 | 4/1953 | Harris . | |
| 2,810,173 | 10/1957 | Bearden . | |
| 2,928,634 | 3/1960 | Bender . | |
| 3,126,181 | 3/1964 | Steeg . | |
| 3,428,183 | 2/1969 | Bristow . | |
| 3,436,878 | 4/1969 | Singer . | |
| 3,909,905 | 10/1975 | Giordano . | |
| 4,253,281 | 3/1981 | Ruttenberg . | |
| 4,497,146 | 2/1985 | Demartini . | |
| 4,841,686 | 6/1989 | Rees . | |
| 5,044,581 | 9/1991 | Dressler . | |
| 5,189,849 * | 3/1993 | Collins | 52/12 |
| 5,228,247 | 7/1993 | Dressler . | |
| 5,617,678 | 4/1997 | Morandin et al. . | |

* cited by examiner

*Primary Examiner*—Christopher T. Kent
(74) *Attorney, Agent, or Firm*—Flynn, Thiel, Boutell & Tanis, P.C.

(57) ABSTRACT

A gutter guard support attaches to a gutter to support a gutter guard which prevents debris, e.g. leaves, twigs, tree buddings, etc., from entering the gutter. The gutter guard support is received on the transverse support members of the gutter and tautly holds the gutter guard (screen) under tension to prevent the creation of debris collecting valleys in the gutter guard.

19 Claims, 7 Drawing Sheets

GUTTER GUARD SUPPORT

FIELD OF THE INVENTION

This invention relates to an improved gutter guard support and, more particularly, to a gutter guard support which is securable to conventional gutter assemblies and supports a gutter guard so as to prevent debris from accumulating in the gutter assembly and on the surface of the gutter guard.

BACKGROUND OF THE INVENTION

Gutters are secured to buildings to collect water running off a roof and to divert this runoff water into down spouts. The water is thereafter directed away from the building perimeter, for example into yards or storm drains. While gutters do an excellent job of collecting runoff water, they also undesirably collect foreign matter including leaves, twigs, tree buddings, and other debris. The collection of debris in gutters interferes with its ability to collect the runoff water and direct the same away from the building perimeter. As a result, the gutters must be periodically cleaned to remove the debris therefrom. Many people find this cleaning task unenjoyable, time consuming or too hazardous due to the height of the gutters above the ground.

Numerous gutter guards have been developed to prevent the collection of debris in the gutter while allowing the runoff water to be received in the gutter. Examples of prior gutter debris guards can be found in U.S. Pat. Nos. 608 844; 1,732,058; and 2,636,458. Some prior gutter guards include gutter screens made of woven metal wire which prevents debris from entering the gutter. Metal wire screens are expensive to manufacture and install relative to nonmetal screens, eg. plastic and nylon screens. Metal screens also can be awkward to remove to perform the cleaning task. Further, if the wire does not have a large enough gauge to prevent sagging under its own weight, the weight of water running off the roof onto the screen or the weight of debris that lands on the screen, then valleys are formed in the screen. Debris collects in these valleys and can interfere with the water collection. Thus like the gutters without gutter guards, one must clean the screen so that runoff water readily flows therethrough into the gutter. Some prior gutter guards have rigid peripheral frames enclosing the gutter guard to provide stability to the gutter guard. However, this significantly increases the cost of manufacturing and installing the gutter guard.

Nonmetal screens are also used in an attempt to prevent debris from collecting in gutters. However, nonmetal screens introduce a drawback, namely, the tendency of nonmetal screens to sag like the light gauge metal screens discussed above. At a sagging portion of the nonmetal screen, debris builds up and blocks water from passing therethrough into the gutter. Consequently, the gutter does not receive the runoff water and the runoff water flows over the debris and undesirably over the side of the gutter closely adjacent the building. Thus, the purpose of the gutter is defeated. Also, the sagging portion permits debris to build up within the gutter resulting in blockage, water back up and water overflow. Additionally, some previous arched gutter guard supports may act as dams to retain debris on the mesh rather than disburse debris from the top of the mesh/screen.

SUMMARY OF THE INVENTION

In recognition of the above disadvantages of the prior gutter guards and in an attempt to provide an improved gutter assembly with gutter guard, there has been developed a gutter guard assembly which secures to known gutter constructions and holds a gutter guard taut so as to prevent valleys from forming in the gutter guard wherein debris can collect. According to the invention, an anchor attaches to a gutter support member and has an anchor post. The anchor post extends into the openings in a gutter guard to hold the same taut across the open top of the gutter. In one embodiment of the invention, a series of anchor posts positioned lengthwise of the gutter tautly hold the gutter guard lengthwise of the gutter.

More specifically, in an embodiment of the invention, an anchor base fits onto a conventional ferrule through which a securement nail is fed to secure the gutter to a building upper side wall. An anchor clamp secures to the anchor base and has the anchor post extending therefrom. The anchor clamp is attached to the anchor base by latching structure, which can include teeth or protrusions. In one construction of the invention, a plurality of anchor clamps, each having one anchor post thereon, are attached to one anchor base. In another construction, a single anchor clamp having a plurality of anchor posts is attached to one anchor base. The anchor posts can be linearly aligned with each other or can be offset. Gutter guard openings receive a plurality of anchor posts and the gutter guard is thus held relatively taut by the anchor posts so as to prevent sagging therein when stretched the length of the gutter.

In another embodiment of the invention, the anchor base and the anchor clamp are an integral anchor. This anchor also has latching structure for securing the anchor to a conventional support bracket that supports the gutter. The anchor has anchor posts which facilitate a taut securement of the gutter guard to the anchor.

BRIEF DESCRIPTION OF THE DRAWINGS

Other objects and purposes of the present invention will be apparent to persons familiar with structures of this general type upon reading the following specification and inspecting the accompanying drawings.

DETAILED DESCRIPTION

Figure 1:
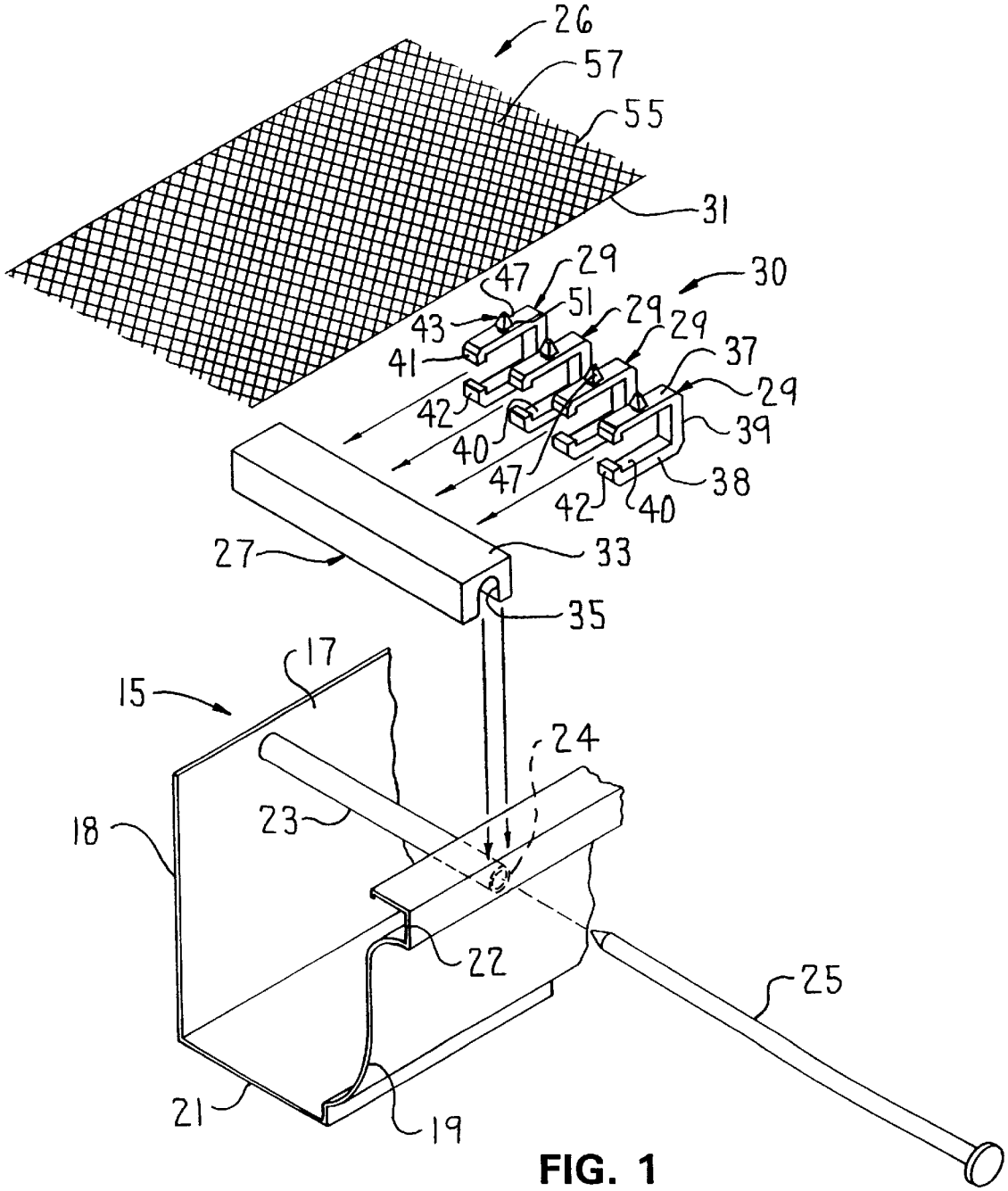
FIG. 1 is an exploded view of a gutter with a gutter guard assembly according to the present invention.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the gutter and designated parts thereof. Said terms will also refer to the conventional orientation of an installed gutter assembly. Said terminology will include the words specifically mentioned, derivatives thereof, and words of similar meaning.

Referring to the drawings, FIG. 1 illustrates therein a conventional gutter assembly 15 which includes an elongate, upwardly open channel 17 defined by upright side walls 18, 19 joined by a horizontal bight 21, an upper portion of the outer side wall 19 having a interiorly open flexion 22 for strengthening the channel 17, a cylindrical ferrule 23 having a through passage 24 which is received in the gutter channel 17 and in the flexion 22, and a nail 25 which extends through aligned holes in the side walls 18, 19 and ferrule passage 24 to secure the gutter channel 17 to a exterior building upper side wall (not shown) beneath a roof edge (not shown) so as to catch the roof runoff water in the channel 17. While only a single ferrule 23 and nail 25 are illustrated and described for brevity, it is understood that a plurality of ferrules and nails are transversely positioned periodically along the longitudinal length of the channel 17 to secure same to the building side wall. Therefore, the description of a ferrule 23 and nail 25 applies to each of the ferrule and nail installations used to support a gutter.

A gutter guard assembly 26 is illustrated which is adapted to be secured to the gutter assembly 15 and more particularly to the ferrule 23. The gutter guard assembly 26 includes a gutter guard, here a gutter screen 31, and a gutter guard support 30. The gutter guard support 30 comprises an anchor base 27 which is adapted to be secured to the periphery of the ferrule 23 and a plurality of anchor clamps 29 securable to the periphery of the anchor base 27 and adapted to support the gutter screen 31.

The anchor base 27 is elongate and preferably extends the length of the ferrule 23 and thus the width of the gutter channel 17. The anchor base 27 has a rectangular parallelepiped, solid body 33 with a height at least slightly less than the height of the flexion 22 so that the outer end portion of the anchor base is received under the lip of the flexion 22. The anchor base 27 has an elongate, outwardly (downwardly in FIGS. 1–7) open recess 35 extending the length of the solid body 33 and having a width and height at least slightly wider and taller than the diameter of the ferrule 23 so that the ferrule can be completely received in the recess and, preferably, the recess snugly fits over the ferrule. The anchor base 27 also has a wall thickness sufficient to significantly reduce, and preferably prevent relative angular rotation or twisting along its length when subject to various angular torques therealong. The various angular torques are applied to the anchor base 27 by the gutter screen 31 being tautly held or stretched on the anchor base 27 and anchor clamp 29 as explained in greater detail below.

Each of the plurality of anchor clamps 29 includes upper and lower arms 37, 38 cantilevered outwardly from opposite ends of a base 39 so as to define a generally C-shape. The base 39 holds the arms 37, 38 spaced apart at a distance only slightly greater than the height of the anchor base 27. The upper arm 37 extends essentially parallel to the top of the gutter channel 17. The inside dimension between arms 37, 38 is a tight fit for the anchor base 27 and overall length of the arms is more than slightly longer than the width of the anchor base 27. Downwardly and upwardly projecting teeth 41, 42 are respectively cantilevered from the free ends of the arms 37, 38. The teeth 41, 42 define an edge of an anchor base receiving opening 40 and the spacing between the teeth has a height slightly less than the height of the anchor base 27.

Figures 2, 3:
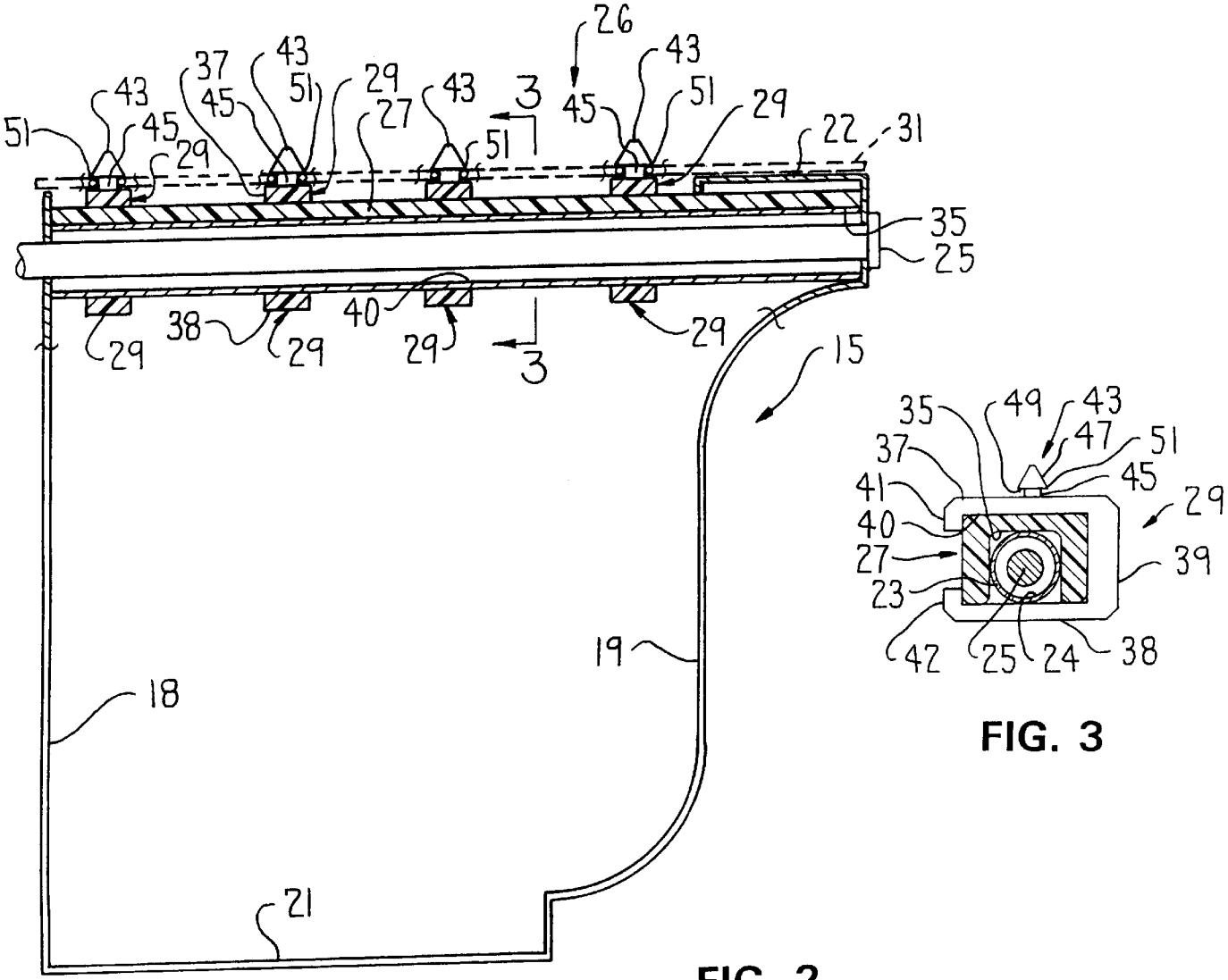
FIG. 2 is a partial sectional view of the gutter guard assembly of FIG. 1.
FIG. 3 is a cross sectional view taken along line 3—3 of FIG. 2.

Each anchor clamp 29 also has an anchor post 43 extending upwardly therefrom. As shown in FIGS. 1–3, the anchor post 43 extends upwardly from the upper arm 37. The anchor post 43 has a stem 45 extending from the upper arm 37 and a screen securement member, here shown as a frustum 47, secured to the top of the stem (FIG. 3). It will be recognized that the stem 45 and frustum 47 can be integral with each other and integral with the anchor clamp 29. The frustum 47 has a base 49 that is wider than stem 45. The frustum 47, as illustrated in FIG. 1, is a truncated top, four sided pyramid having four screen securement ledges 51. However, it will be recognized that the frustum 47 may have other shapes including frustoconical and conical as long as the base thereof is wider than the stem to create securement surfaces or ledges to hold the gutter screen 31 thereunder.

The gutter screen 31 includes relatively closely meshed strands 55 defining openings 57 through which runoff water may flow (FIG. 1). The strands 55 are preferably made of an elastic material and have a width slightly less than base 49 and substantially equal to or slightly less in relation to the height of the stem 45. The screen 31 is elongate and preferably extends the longitudinal length (i.e. leftwardly and rightwardly when facing the gutter) of the gutter channel 17. The screen 31 has a width so that it is at least as wide as the open top of the gutter channel 17 and preferably extends over both side walls 18, 19 and flexion 22.

The gutter guard assembly 26 can be assembled onto the gutter 15 by the recess 35 in the anchor base 27 receiving the ferrule 23 therein (FIG. 2) in a snug relationship. In a new gutter installation, the ferrule 23 and anchor base 27 are then aligned in the gutter channel 17 and flexion 22 to receive the nail 25 therethrough so as to secure the channel 17 to the building upper side wall. In a retrofit installation, the ferrule 23 and nail 25 are already installed securing the gutter 15 to a building. Thus, the anchor base 27 is inserted onto the ferrule 23. The anchor base 27 being received in the flexion 22 helps prevent the anchor base from pivoting clockwise and/or counter-clockwise on the ferrule 23. A plurality of anchor clamps 29 are mounted onto the anchor base 27 by forcing the anchor base past the teeth 41 and 42 into the opening 40. The cantilevered arms 37, 38 elastically flex to allow the anchor base 27 to slide past teeth 41, 42. Once the anchor base 27 moves past the teeth 41, 42, the arms 37, 38 return to their nonflexed state and the teeth 41, 42 extend partly along one side of the anchor base 27 remote the base 39 so as to latch the anchor clamp onto the anchor base. The lower arm 38 extends across the recess 35 so as to hold the ferrule 23 in a snug manner within the recess 35. The upper surface of the upper arm 37 extends coplanar to the upper surfaces of side wall 18 and flexion 22. The upper arm 37 is positioned on top of the anchor base 27 so that the anchor post 43 extends upwardly from the upper surface of the upper arm. The screen 31 is thereafter secured across the open top of the gutter channel 17 and, as shown in FIG. 2, extends over both side walls 18, 19 and the flexion 22. The screen openings 57 receive the anchor posts 43 therein so that the frustum 47 and hence the securement ledges extend over the screen strands 55 to secure the screen onto the anchor posts. The screen 31 is initially mounted onto the anchor posts 43 at one end of the gutter channel 17 and then is stretched to the next adjacent set of anchor posts 43, which are secured to anchor clamps and anchor base on the next adjacent ferrule. Thus, the screen 31 is mounted thereon under tension between adjacent sets of anchor posts 43 and gutter guard supports 30. As a result, the screen 31 is essentially planar and no valleys are formed in the screen in which debris can build up.

Figure 5:
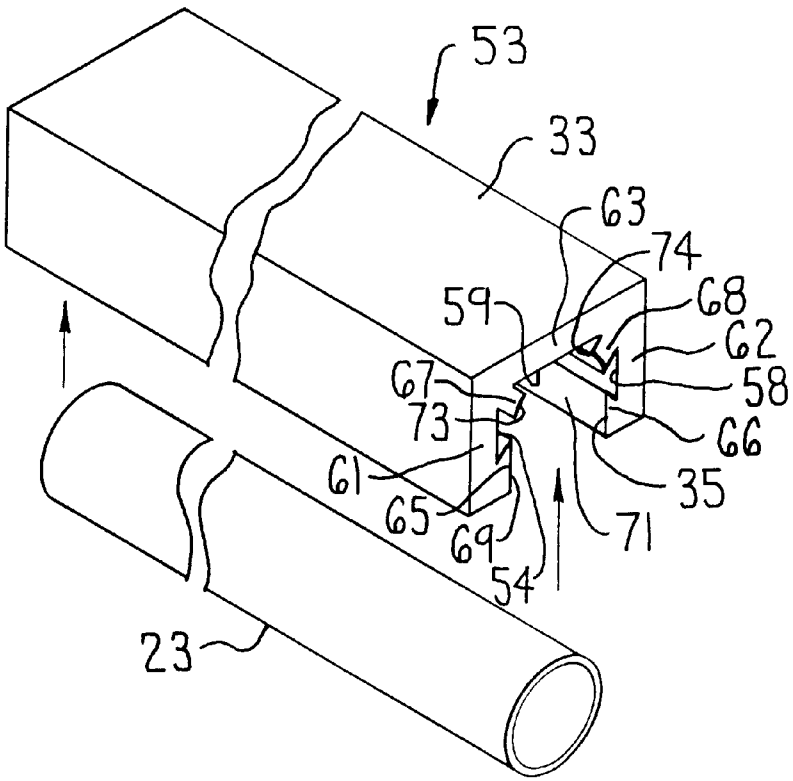
FIG. 5 is a exploded view of the FIG. 4 anchor base and ferrule.
Figure 4:
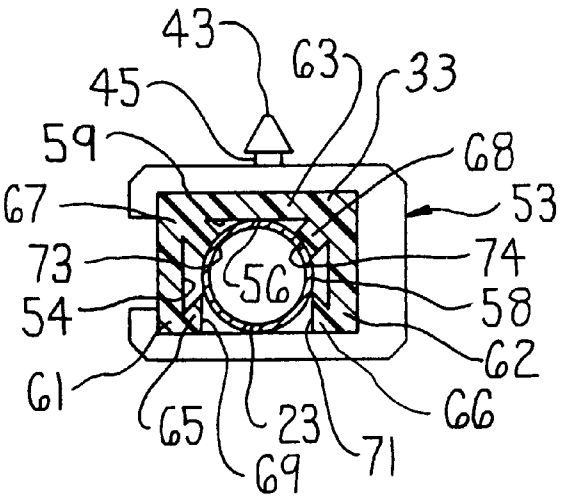
FIG. 4 is a view like FIG. 3, but of a modified anchor base.

Referring to FIGS. 4 and 5, there is illustrated a modified anchor base 53 which is similar to the above described anchor base 27 except that the recess 35 has notches 54, 58, 59 formed therein. The same reference numbers are used in FIGS. 4 and 5 to designate elements which are the same as above described elements. The notches 54, 58, 59 are elongate and extend the length of the anchor base 53 and each notch widens into the solid body 33 of the anchor base. Side notches 54, 58 are positioned in the side members 61, 62 of the solid body and have generally the same dimensions. Top notch 59 is positioned in the top member 63 of the solid body 33 and is wider and shallower than the side notches 54, 58 so that the ferrule 23 can contact against the inward wall 56 of the top notch. Moreover, the notches 54, 58, 59 create four protrusions 65–68. The lower protrusions 65, 66 adjacent the open mouth of the recess 35 have flat end surfaces 69, 71. The upward protrusions 67, 68 have concave end surfaces 73, 74 so that the outer cylindrical surface of the ferrule 23 generally mates thereagainst. This modified anchor base 53 is assembled as described above by replacing the above described anchor base 27.

Figure 6:
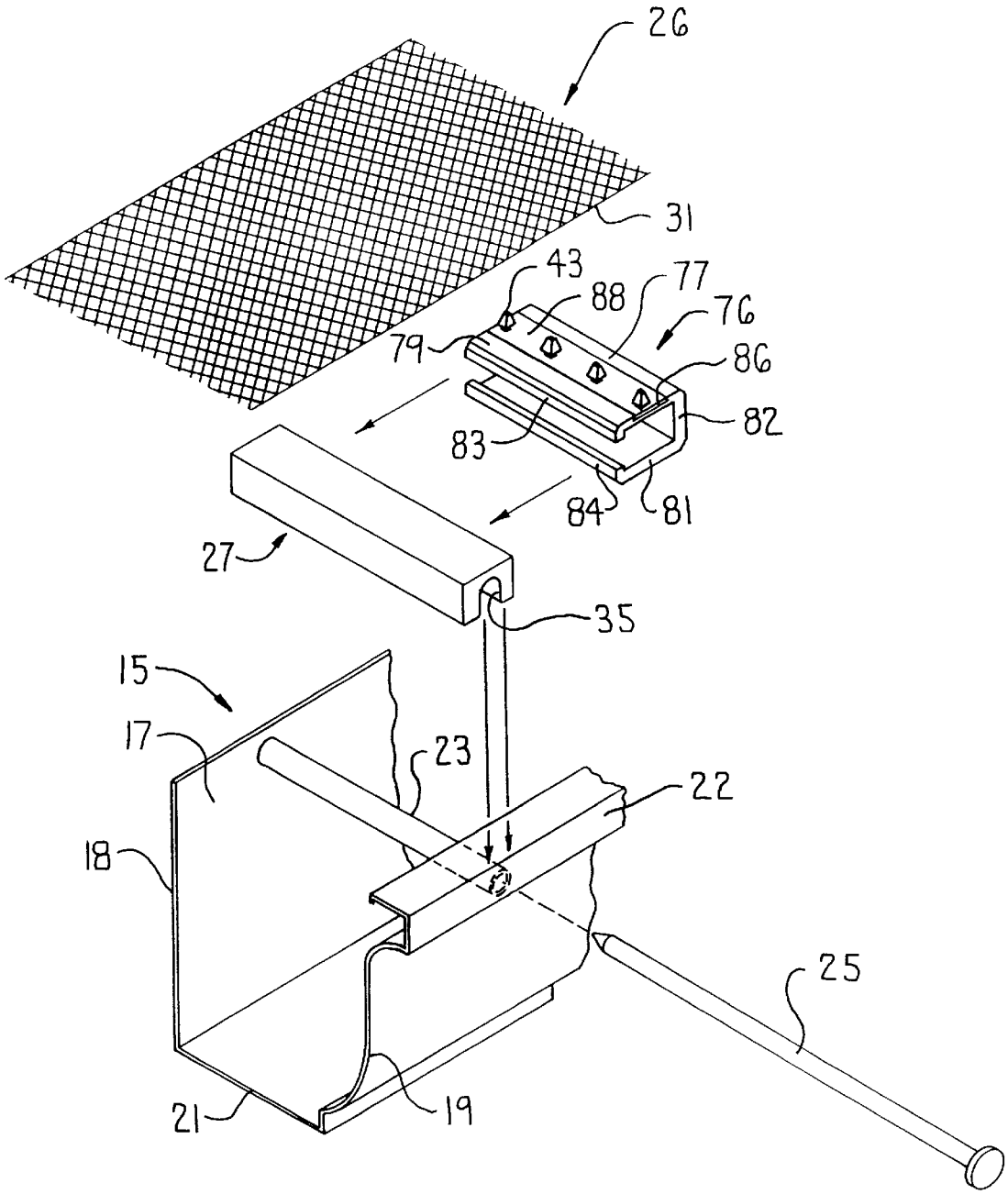
FIG. 6 is a view of a modification of the FIG. 1 embodiment.

Referring now to FIG. 6, there is illustrated a gutter assembly 15 including a modified anchor clamp 76. The remaining elements are the same as those described above and are designated by the same reference numbers. The anchor clamp 76 is elongate but shorter that the anchor base 27 at least by the depth of the flexion 22 and has a unitary, C-shaped body 77 with upper and lower arms 79, 81 cantilevered from ends of a base 82. Downwardly and upwardly projecting teeth 83, 84 are respectively cantilevered from the free ends of the arms 79, 81. An outwardly open recess 86 is formed in the upper arm 79 and extends the length of the body 77 and securely receives an anchor post base 88 therein. The anchor post base 88 is a trapezoidal cross section solid with integral, in-line anchor posts 43 extending upwardly therefrom. The anchor clamp 76 is mounted onto the anchor base 27 in the same manner as discussed above with regard to anchor clamps 29.

Figure 7:
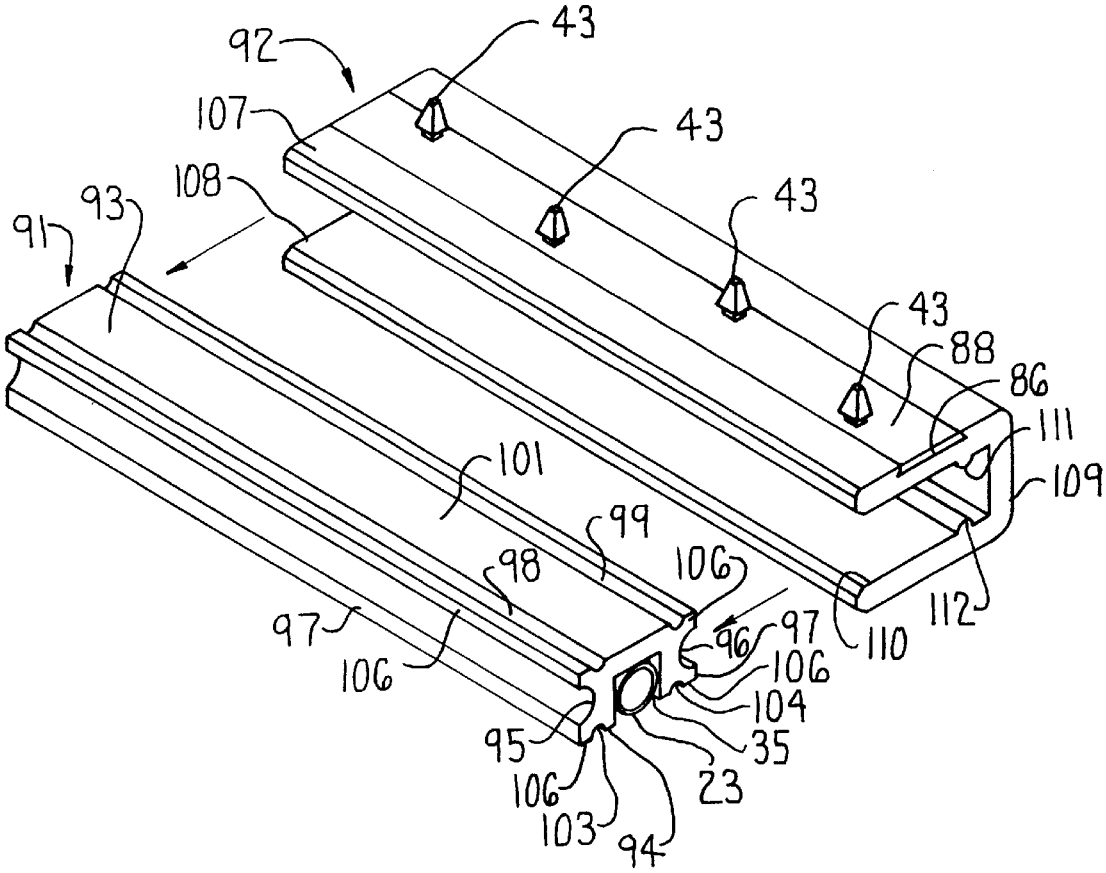
FIG. 7 is a view of a modification of the FIG. 6 embodiment.

Referring now to FIG. 7, there is illustrated a modified anchor including anchor base 91 and anchor clamp 92. Elements that are the same as those described above are designated by the same reference numerals. The anchor base 91 includes a solid rectangular parallelpiped body 93 in which the downwardly open recess 35 is formed in the downward surface 94 for receiving the ferrule 23. The anchor base 91 also has longitudinally extending side recesses 95, 96 formed in the outward sides surfaces 97, longitudinally extending top recesses 98, 99 formed in the top surface 101 inset from the side surfaces 97 and laterally offset from the recess 35, and longitudinally extending bottom recesses 103, 104 formed in the bottom surface 106 inset from the side surfaces 97 and laterally offset from the recess 35. The top recesses 98, 99 are respectively vertically aligned with and are the same size as the bottom recesses 103, 104. The side recesses 95, 96 have a larger diameter than the top and bottom recesses 98, 99, 103, 104. Consequently, the body 93 has legs 106 extending to each longitudinal edge thereof, which legs 106 are defined by the recesses 95, 96, 98, 99, 103, 104. The legs 106 can elastically flex toward the larger diameter side recesses 95, 96. Further, the anchor base 91 is symmetrical about a central longitudinal vertical plane.

The anchor clamp 92 includes parallel arms 107, 108 cantilevered from opposite ends of an anchor clamp base 109 defining a generally C-shaped clamp with an opening 110 therein at least slightly greater than and essentially equal to the height of the anchor base 91. A recess 86 is formed in the upper surface of upper arm 107 which receives an anchor post base 88 therein. The anchor post base 88 includes a plurality of nonaligned anchor posts 43 securely extending upwardly therefrom (FIG. 7). Anchor posts 43 can be aligned as an option. Each arm 107, 108 includes an elongate latching protuberance 111, 112 extending the length of the respective arm and into the opening 110. The protuberances 111, 112 are parallel to the base 109 and are vertically aligned with one another. The protuberances 111, 112 are spaced from the base 109 the same distance as the top and bottom recesses 98, 99, 103, 104 are inset from the outer sides 97.

The anchor clamp 92 snap fits over the anchor base 91 by receiving the anchor base 91 in its opening 110. The protuberances 111, 112 contact the first inserted side surface 97 and force the first inserted legs 106 to flex toward the first inserted side recess, side recess 96 as illustrated in FIG. 7, and away from the protuberances 111, 112 during initial insertion. The anchor clamp 92 continues to slide over the anchor base 91 until the protuberances 111, 112 are received in the respective top and bottom recesses 99, 104 as illustrated in FIG. 7. In an alternate embodiment, the legs 106 are rigid and the arms 107, 108 flex to allow the legs to slide past the protuberances 111, 112 so that the recesses 99, 104 respectively receive the protuberances. The protuberances 111, 112 and recesses 99, 104 latchingly secure the anchor base 91 and anchor clamp 92 together (FIG. 7). It will be recognized that the anchor clamp 92 can slide over the anchor base 91 from the other side or direction because the anchor base 91 is symmetrical about a central longitudinal vertical plane. Thus, the anchor base 91 can receive the anchor clamp 92 in either direction relative to the pull exerted thereon by installation of the gutter guard thereon.

Figures 8, 9, 10:
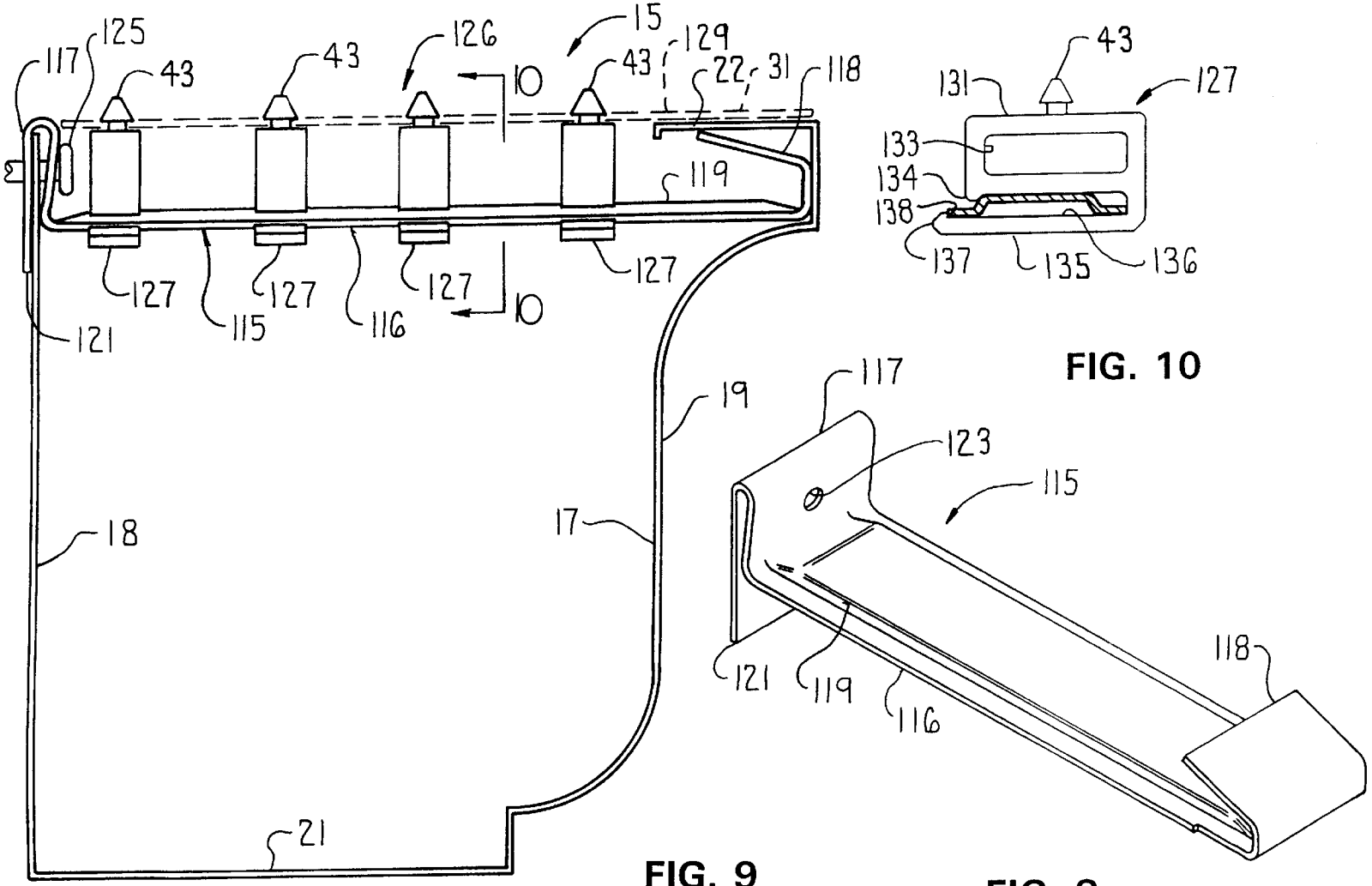
FIG. 8 is a view of a conventional gutter support bracket.
FIG. 9 is a partial sectional view of a gutter assembly with a modified gutter guard support for use with the FIG. 8 gutter bracket according to the present invention.
FIG. 10 is a cross sectional view taken along line 10—10 of FIG. 9.

Referring to FIGS. 8–10, there is illustrated an alternate conventional gutter construction and a second embodiment of the gutter guard support of the present invention. Elements that are the same as those described above are designated by the same reference numerals for ease of description. This gutter assembly 15 includes a conventional rigid truss 115 for supporting the channel 17 on an exterior building upper side wall. The truss 115 comprises an elongate intermediate beam 116 which extends the width of the gutter channel 17, an inverted U-shaped bracket 117 cantilevered from one end of the beam 116, and a flange 118 cantilevered from the other end of the beam 116. The beam 116 includes an upraised central portion 119 to strengthen the beam. The bracket 117 includes a free end portion 121 that extends beneath the beam 116. The bracket 117 opens downwardly so that it can be slid over an upper portion of the rear wall 18 of conventional gutter assembly and includes an aperture 123 through which an attachment nail or rivet 125 is received to secure the truss 115 and the channel 17 to the building upper side wall. The flange 118 bends upwardly and then back over the beam 116 less than the width of the flexion 22 so that the entire flange is mounted within the flexion. All to secure and support weight of channel assembly 15.

The gutter guard assembly 126 comprises a plurality of anchors 127 and a gutter guard screen 31. The anchors 127 of this embodiment replace the anchor base and anchor clamps in the previous described embodiments. Further, the anchors 127 are identical to each other, therefore, only one will be described for brevity. The anchor 127 has a generally rectangular parallelepiped upper body 131, which has a laterally extending through bore 133 and a downwardly and laterally extending nub 134 at a lower front edge of the body 131. The anchor post 43 is secured to and extends upwardly from a top surface of the body 131. The body 131 has a height so that the anchor post 43 extends above the open top of the channel 17. The gutter guard screen 31 is held by the anchor post 43 on top of the anchor 127 and top of the flexion 22. An underwrapped arm 135 is cantilevered from the lower rear edge of the body 131 to define a laterally and frontwardly open slot 136 between the arm 135 and bottom of the body 131. The slot 136 has a height generally equal to the height of the beam 116 and its center upraised portion 119. The arm 135 has a length longer than the length of the body 131 and has an enlarged free end 137 forming an upraised retaining shoulder 138.

To assemble this gutter assembly 15 including gutter guard assembly 126, a plurality of trusses 115 are transversely positioned in the channel 17 with the upper portion of the rear side wall 18 being received in respective brackets 117 and respective flanges 118 being received within the flexion 22. Nails or rivets 125 extend through respective apertures 123 and the rear wall 18 to secure the gutter 15 to a building upper side wall. A plurality of anchors 127 are spacedly secured to each truss 115. For each anchor 127, the slot 136 receives the beam 116 with the upraised central portion 119 in contact with the bottom of the body 131 and the nub 134 contacting a side of the upraised central portion 119 to assist in holding the anchor 127 on the truss 115. The shoulder 138 acts as a stop against the side of the beam 116 to further assist in holding each anchor 127 on the truss. All anchors 127 should be placed in same direction. Thereafter, the elastic gutter screen 31 receives the anchor posts 43 therethrough and is pulled to the next, and preferably adjacent, truss 115 having the anchors 127, and hence anchor posts 43, thereon. The screen 31 receives the next anchor posts 43 so that the screen is under tension between adjacent sets of anchors 43. Thus, the anchors 127 act as gutter guard supports to tautly hold the gutter guard, here screen 31, under tension so as to prevent the formation of debris gathering valleys.

Figure 11:
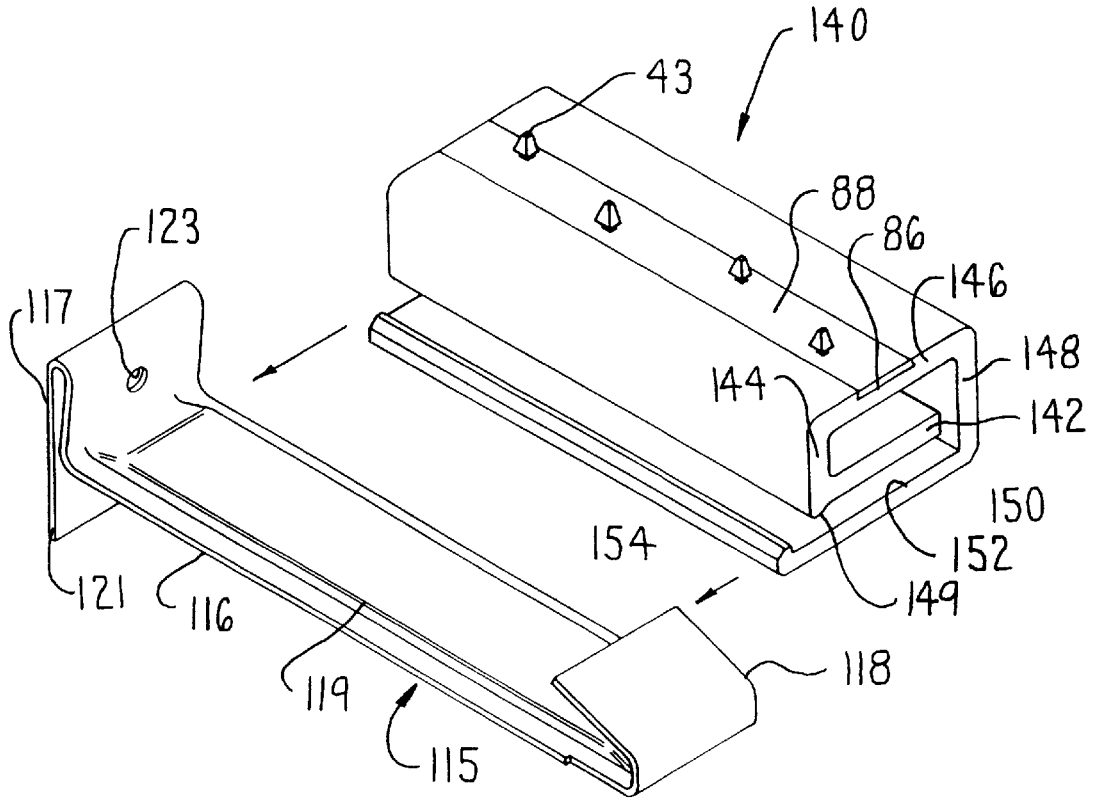
FIG. 11 is a view of a modified embodiment of FIGS. 9–10.

Referring to FIG. 11, there is illustrated a modification of the FIGS. 8–10 embodiment. Elements which are the same as those described above are designated by the same reference numerals. Essentially, the FIG. 11 modification integrates a plurality of FIGS. 8–10 embodiment anchors 127 into a single elongate anchor 140 for each truss 115. The anchor 140 includes a generally rectangular parallelpiped horizontal intermediate wall 142, a generally rectangular parallelpiped vertical front wall 144 connected to a front end of the intermediate wall 142, a generally rectangular parallelpiped horizontal top wall 146 connected to a top end of the front wall 144, and a generally rectangular parallelpiped vertical rear wall 148 connected to a rear end of the top wall 144. Thus, the intermediate wall 142 is cantilevered from the front wall 144. The top wall 146 includes the recess 86 therein for mounting the anchor post base 88, from which the anchor posts 43 upwardly extend. At the joint of the intermediate wall 142 and the front wall 144, a nub 149 extends downwardly below the intermediate wall 142 generally aligned with the front wall 144. The rear wall 148 is longer than the front wall 144 so that it extends past the intermediate wall 142. A generally rectangular parallelpiped arm 150 is cantilevered from the end of the rear wall 148, which end is remote the top wall 146, and extends generally parallel to the intermediate wall 142. As a result, a laterally and frontwardly open slot 152 is formed between the intermediate wall 142 and the arm 150. The height of the slot 152 is generally equal to or slightly greater than the height of the beam 116 and upraised portion 119 so that the beam 116 can be received in the slot. The free end 154 of the arm 150 is vertically enlarged to form a retaining shoulder. The arm 150 has a length between the rear wall 148 and enlarged free end 154 which is essentially equal to the width of the beam 116.

During assembly of the anchor 140 onto the truss 115, the beam 116 is received in the slot 152. The arm 150 flexes slightly to allow the beam and upraised portion 119 to be readily slid into the slot 152. Further, because the intermediate wall 142 is not connected to the rear wall 148, the rear wall 148 may also slightly flex to relieve the stress on the flexed arm 150. When assembled, the nub 149 assists in holding the beam 116 in the slot 152 by contacting the front edge of the upraised portion 119. The enlarged free end 154 extends above longitudinal edge of the beam 116 to retain the beam 116 in the slot 152.

Although particular preferred embodiments of the invention have been disclosed in detail for illustrative purposes, it will be recognized that variations or modifications of the disclosed apparatus, including the rearrangement and duplication of parts, lie within the scope of the present invention.

What is claimed is:

1. In a gutter assembly secured to a building side wall for collecting run off water from a roof, including an elongate gutter channel with an open top and spaced side walls, a plurality of gutter securement members transversely extending between said side walls adjacent said open top and longitudinally spaced in said channel for facilitating securement of said channel to a building side wall, and an elastic gutter guard screen preventing debris from entering said channel and allowing the run off water to pass therethrough and enter said channel, the improvement comprising:

a plurality of gutter guard supports each configured to be attached directly to a respective one of said plurality of gutter securement members, each said gutter guard support including at least one upright anchor post configured for insertion in a respective opening in said gutter guard screen, said gutter guard screen being held under tension by respective said anchor posts on adjacent said gutter guard supports respectively mounted directly on said adjacent gutter securement members so as to tautly hold said gutter guard screen on said gutter guard supports across the open top of said channel, whereby debris is prevented by said tautly held gutter guard screen from entering said channel and water passes through said gutter guard screen into said channel.

2. The gutter assembly according to claim 1, wherein each said anchor post includes a stem and a screen securement member mounted on top of said stem, said screen securement member being slightly wider at its base than said stem so as to define a securement ledge which extends over said gutter guard screen when said opening in said gutter guard screen receives said anchor post therein.

3. The gutter assembly according to claim 1, wherein each said gutter securement member includes a ferrule inserted into said channel and a fastener extending transversely through both side walls of said channel and said ferrule to secure said channel to a building side wall, each said gutter guard support including an elongate anchor base having an outwardly open recess for receiving therein said ferrule and at least one anchor clamp snap fit on said anchor base, said anchor clamp including a first arm extending across said recess so as to hold said ferrule therein, said anchor post extending outwardly from said anchor clamp through said open top of said channel so that said gutter guard screen is secured thereat.

4. The gutter assembly according to claim 3, wherein each said anchor clamp has a base and a second arm, said first and second arms being cantilevered from opposite ends of said base, said anchor post extending outwardly from the upper one of said first arm, said second arm and said base.

5. The gutter assembly according to claim 4, wherein said first and second arms respectively include first and second teeth extending from the free ends thereof, said first and second teeth extending toward one another to define an opening therebetween which is at least slightly less than the height of said anchor base, and said teeth extending partly along a surface of said anchor base remote from said base so as to hold said anchor clamp on said anchor base.

6. The gutter assembly according to claim 5, wherein said outwardly open recess opens downwardly so that each said anchor base is received over said ferrule from above, each said anchor post extends outwardly and upwardly from said second arm, and said gutter guard screen is secured between said securement ledge and an upper surface of said second arm.

7. The gutter assembly according to claim 6, wherein a plurality of said anchor clamps are snap fit onto each said anchor base, and wherein each said anchor clamp has at least one said anchor post secured thereto and extending upwardly therefrom and a top surface generally coplanar with the top surface of said gutter channel so that said screen is positioned above said gutter channel.

8. The gutter assembly according to claim 3, wherein each said anchor clamp has a plurality of in-line anchor posts extending upwardly therefrom.

9. The gutter assembly according to claim 3, wherein each said anchor clamp has a plurality of nonaligned anchor posts extending upwardly therefrom.

10. The gutter assembly according to claim 3, wherein said anchor base includes a plurality of notches within said outwardly open recess defining therebetween a plurality of protrusions against which said ferrule seats.

11. The gutter assembly according to claim 3, wherein said anchor base includes at least one longitudinally extending latching recess, and said anchor clamp includes at least one latching protrusion, said latching protrusion seating in said latching recess to positively latch said anchor clamp onto said anchor base.

12. The gutter assembly according to claim 11, wherein said at least one latching recess includes first and second latching recesses, and said at least one latching protrusion includes first and second latching protrusions, said first and second latching protrusion being respectively received in said first and second latching recesses when said anchor clamp is mounted on said anchor base so as to positively latch said anchor base and clamp together.

13. The gutter assembly according to claim 12, wherein said at least one latching recess further includes third and fourth latching recesses each adapted to respectively receive said first and second latching protrusions therein if said anchor clamp is mounted to said anchor base from a side opposite said first and second latching recesses, and said anchor base is symmetrical about a vertical longitudinal central plane.

14. The gutter assembly according to claim 1, wherein said gutter securement member includes a truss extending between both side walls of said channel and a fastener extending through only one side wall of said channel and said truss to secure said channel and said truss to a building side wall, and said gutter guard support including an anchor having a body and a latching arm extending beneath and cantilevered from said body so as to define a latching slot therebetween, said latching slot receiving said truss therein to secure said anchor to said truss, and said anchor post extending upwardly from a top surface of said body remote from said latching arm.

15. The gutter assembly according to claim 14, wherein said truss has an elongate beam and an upraised portion on said beam, wherein said body includes a downwardly extending nub which contacts one side of said upraised portion to assist in holding said truss in said latching slot, and the free end of said latching arm is enlarged to form a retaining shoulder contacting an edge of said beam so as to hold said beam in said latching slot.

16. The gutter assembly according to claim 15, wherein a plurality of said anchors are mounted to said beam.

17. The gutter assembly according to claim 15, wherein said body has a vertical front wall, a generally horizontal intermediate wall cantilevered from a lower edge of said front wall, a generally horizontal top wall extending from an upper edge of said front wall, and a vertical rear wall extending downwardly from a rear edge of said top wall, said rear wall being taller than said front wall so that said rear wall extends past said intermediate wall, said latching arm being forwardly cantilevered from a lower edge of said rear wall, and said beam is held between said rear wall, said intermediate wall and said enlarged free end of said latching arm.

18. A method for mounting an elastic gutter guard screen on a gutter so as to prevent creation of debris collecting valleys in the gutter guard screen, the gutter being secured to a building by a plurality of securement members, comprising the steps of:

snap fitting gutter guard anchors onto the securement members;

mounting the elastic gutter guard screen onto an anchor post of at least one anchor secured to one said securement member;

stretching said elastic gutter guard screen to an adjacent anchor post on an adjacent securement member;

thereafter mounting the elastic gutter guard screen onto an anchor post of at least one anchor post on the adjacent securement member; and tautly holding said screen between the two adjacent anchors under tension so as to prevent the formation of valleys therebetween.

19. The method according to claim 18, further comprising the steps of repeating the stretching, thereafter mounting and holding steps until all of the anchors support the gutter guard screen under tension so that the screen is valley free.

* * * * *